US010995537B2

(12) United States Patent
Hall et al.

(10) Patent No.: US 10,995,537 B2
(45) Date of Patent: May 4, 2021

(54) MOTORIZED GEAR SLIDING WINDOW OR DOOR SYSTEM

(71) Applicants: David R. Hall, Provo, UT (US); Jerome Miles, Spanish Fork, UT (US); Nathan Davis, Bountiful, UT (US)

(72) Inventors: David R. Hall, Provo, UT (US); Jerome Miles, Spanish Fork, UT (US); Nathan Davis, Bountiful, UT (US)

(73) Assignee: Hall Labs LLC, Provo, UT (US)

( * ) Notice: Subject to any disclaimer, the term of this patent is extended or adjusted under 35 U.S.C. 154(b) by 136 days.

(21) Appl. No.: 15/867,431

(22) Filed: Jan. 10, 2018

(65) Prior Publication Data

US 2019/0162007 A1 May 30, 2019

Related U.S. Application Data

(63) Continuation-in-part of application No. 15/822,394, filed on Nov. 27, 2017, now Pat. No. 10,822,857.

(51) Int. Cl.

| | |
|---|---|
| ***E05F 15/635*** | (2015.01) |
| ***E06B 3/46*** | (2006.01) |
| ***E05B 65/08*** | (2006.01) |
| *E05D 15/06* | (2006.01) |

(52) U.S. Cl.

CPC ..... *E05F 15/635* (2015.01); *E05B 65/08* (2013.01); *E06B 3/4618* (2013.01); *E06B 3/4636* (2013.01); *E05D 15/0621* (2013.01); *E05Y 2201/722* (2013.01); *E05Y 2400/66* (2013.01); *E05Y 2600/46* (2013.01)

(58) Field of Classification Search

CPC ..... E05F 15/635; E05F 15/77; E05F 15/643; E05Y 2201/722; E05D 15/0621; E05B 65/08; E05B 3/4618; E05B 3/4636

See application file for complete search history.

(56) References Cited

U.S. PATENT DOCUMENTS

| | | | | | |
|---|---|---|---|---|---|
| 1,757,751 | A | * | 5/1930 | Strauss | E05F 15/665 49/361 |
| 2,531,116 | A | * | 11/1950 | Donoghue | E05F 15/71 49/23 |
| 3,237,250 | A | * | 3/1966 | Scoville | E06B 3/4609 49/136 |
| 3,241,283 | A | * | 3/1966 | Ahlgren | E06B 3/4609 49/425 |
| 5,261,187 | A | * | 11/1993 | Prenger | E05F 15/635 49/362 |
| 5,351,441 | A | * | 10/1994 | Hormann | E06B 11/045 49/362 |

(Continued)

*Primary Examiner* — Justin B Rephann

(57) ABSTRACT

Devices, systems, and methods for a frame with a slidable segment are disclosed. The slidable segment is slidably mounted within the frame. A first motor is coupled to the slidable segment. The first motor has a first gear affixed to and driven by the first motor. A first gear track may be mounted to a first horizontal member of the frame, wherein teeth of the first gear align with tooth spaces of the first gear track. Rotating the first gear in a first rotational direction causes the first gear to pull the slidable segment in a first linear direction as the first gear walks along the first gear track. Rotating the first gear in a second rotational direction causes the first gear to pull the slidable segment in a second linear direction as the first gear walks along the first gear track.

17 Claims, 6 Drawing Sheets

(56) References Cited

U.S. PATENT DOCUMENTS 5,355,624 A * 10/1994 Bacon ..... E05F 15/635 49/280
5,515,650 A * 5/1996 Machill ..... E06B 11/045 49/362
5,680,729 A * 10/1997 Heffington ..... E05F 15/53 49/362
6,055,775 A * 5/2000 Dering ..... E05F 1/1091 49/340
6,091,217 A * 7/2000 Parsadayan ..... E05F 15/41 318/283
6,233,878 B1 * 5/2001 Krahenbuhl ..... E05F 15/632 52/64
6,267,168 B1 * 7/2001 Davies ..... E05D 15/0604 160/23.1
6,481,160 B1 * 11/2002 Kowalczyk ..... E05F 3/224 49/333
6,581,332 B1 * 6/2003 Kim ..... E05F 15/77 49/358
8,474,186 B2 * 7/2013 Dufour ..... B60J 1/1853 49/380
8,595,977 B2 * 12/2013 Hancock ..... E05F 15/635 49/349
8,931,216 B2 * 1/2015 Gazda ..... E05D 15/0656 52/64
2001/0011579 A1 * 8/2001 Davies ..... E05D 15/0604 160/23.1
2006/0150520 A1 * 7/2006 Hamazaki ..... E05B 65/08 49/449
2008/0163553 A1 * 7/2008 Liao ..... E05F 11/423 49/362
2012/0023827 A1 * 2/2012 Hancock ..... E05F 15/635 49/360
2014/0047768 A1 * 2/2014 Vaknin ..... E05D 15/06 49/25
2015/0020617 A1 * 1/2015 Neumann ..... F16H 19/04 74/30
2017/0101816 A1 * 4/2017 Kozonasky ..... E05F 15/77
2018/0355660 A1 * 12/2018 Noy ..... E05D 15/0665
2018/0363356 A1 * 12/2018 Hohwart ..... E05F 15/635

* cited by examiner

MOTORIZED GEAR SLIDING WINDOW OR DOOR SYSTEM

RELATED APPLICATIONS

This application is a continuation-in-part of U.S. patent application Ser. No. 15/822,394, filed Nov. 27, 2017, which is hereby incorporated by reference herein in its entirety.

FIELD OF THE INVENTION

The devices, systems, and methods described herein relate generally to the Internet of Things. More particularly, the devices, systems, and methods described herein relate to smart home devices.

BACKGROUND

Many improvements and developments have been made in the field of Smart Home devices. However, many devices, especially existing devices (such as windows and doors, for example) in a residence or business, simply aren't smart and/or weren't designed to be smart. It is desirable to be able to convert otherwise dumb devices into smart devices.

SUMMARY

Devices, systems, and methods for a frame with a slidable segment are disclosed. The slidable segment (e.g., a window or door) is slidably mounted within the frame (e.g., a window frame or a door frame). A first motor is coupled to the slidable segment. The first motor has a first gear affixed to and driven by the first motor. A first gear track may be mounted to a first horizontal member of the frame, wherein teeth of the first gear align with tooth spaces of the first gear track. Rotating the first gear in a first rotational direction causes the first gear to pull the slidable segment in a first linear direction as the first gear walks along the first gear track. Rotating the first gear in a second rotational direction causes the first gear to pull the slidable segment in a second linear direction as the first gear walks along the first gear track.

A second motor may be coupled to the slidable segment, with a second gear affixed to and driven by the second motor and a second gear track mounted to the other horizontal member of the frame. Teeth of the second gear may align with tooth spaces of the second gear track. The first gear and the second gear may be oriented anti-parallel to each other such that rotating the second gear in the second rotational direction causes the second gear to pull the slidable segment, in conjunction with the first gear, in the first linear direction as the second gear walks along the second gear track, and rotating the second gear in the first rotational direction causes the second gear to pull the slidable segment, in conjunction with the first gear, in the second linear direction as the second gear walks along the second gear track.

The first horizontal member may be a bottom horizontal member of the frame and the second horizontal member may be a top horizontal member of the frame. The frame may be a window frame or a door frame. The frame may have a fixed segment offset from the slidable segment such that the slidable segment can slide past the fixed segment.

The first motor may include one or more communication systems, including Bluetooth communication chips, Internet Wi-Fi transceivers, network transceivers, a Z-Wave network transceiver, or a combination thereof. The one or more communication systems may communicate with an external remote controller. The one or more communication systems may receive instructions from the external remote controller, generate signals instructing the first motor to rotate in a direction, receive signals from the first motor regarding a status of the first motor, and generate a signal informing the external remote controller of the status of the first motor.

BRIEF DESCRIPTION OF THE DRAWINGS

In order that the advantages of the described devices, systems, and methods will be readily understood, a more particular description of the described devices, systems, and methods briefly described above will be rendered by reference to specific embodiments illustrated in the appended drawings. Understanding that these drawings depict only typical embodiments of the described devices, systems, and methods and are not therefore to be considered limiting of its scope, the devices, systems, and methods will be described and explained with additional specificity and detail through use of the accompanying drawings, in which.

DETAILED DESCRIPTION

It will be readily understood that the components of the described devices, systems, and methods, as generally described and illustrated in the Figures herein, could be arranged and designed in a wide variety of different configurations. Thus, the following more detailed description of the embodiments of the described devices, systems, and methods, as represented in the Figures, is not intended to limit the scope of the described devices, systems, and methods, as claimed, but is merely representative of certain examples of presently contemplated embodiments in accordance with the described devices, systems, and methods.

Automatic opening and closing of sliding windows and sliding doors generally requires planning ahead and use of frames that are designed specifically for automatic sliding doors and automatic sliding windows. However, when automation of an existing installation is desired, a complete replacement of the existing frame is costly and requires more construction skill than the typical homeowner possesses. The devices, systems, and methods disclosed herein disclosed provide solutions to this issue. A motor installed on the sliding segment of the door or window is coupled by a gear to a gear track (as in a rack and pinion). The gear track is attached to one of the horizontal members of the frame. Rotation of the gear walks the gear along the gear track, causing the sliding segment to move from closed to open and back again. This solution is cost effective and requires minimal construction skill.

Figure 1A:
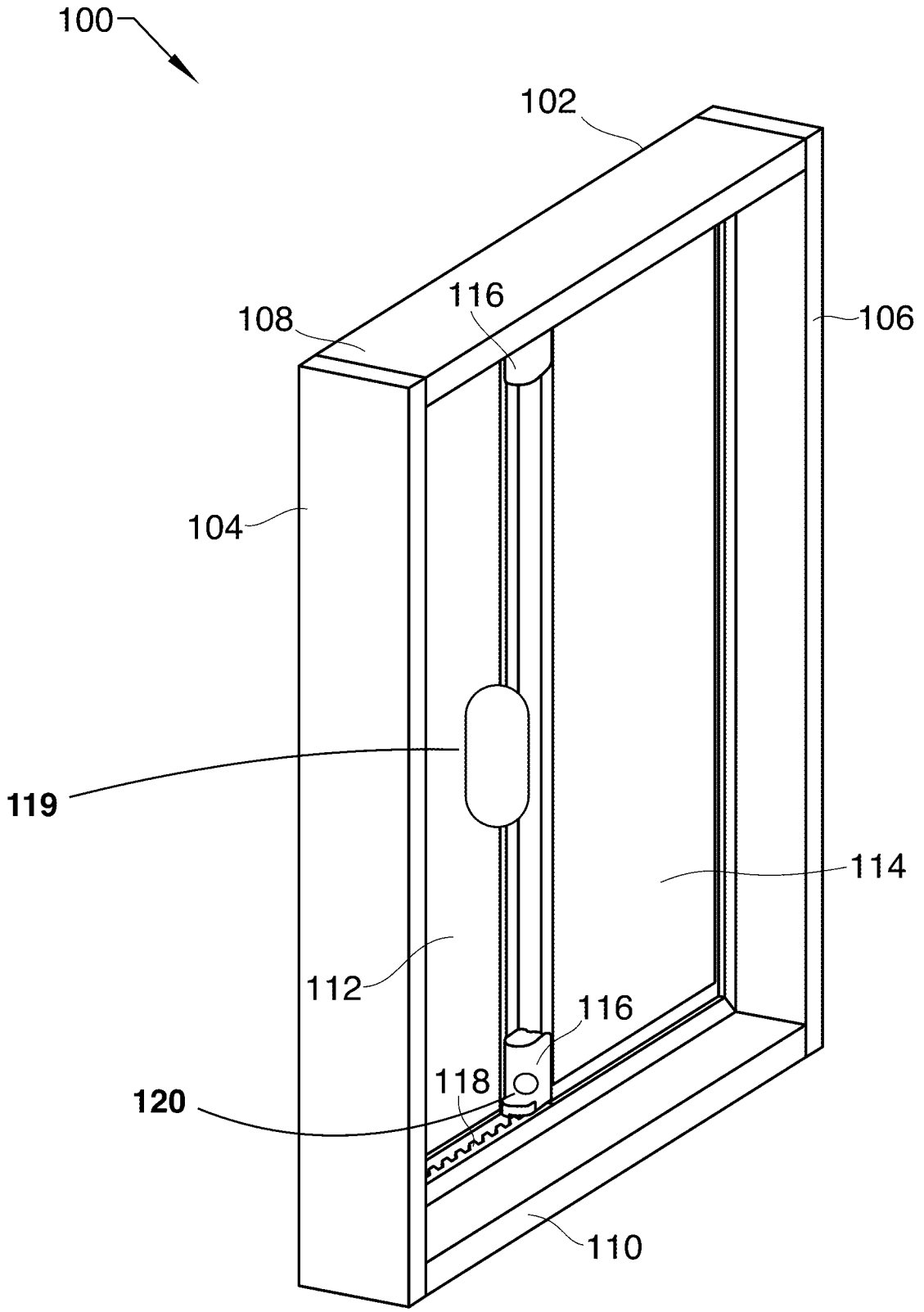
FIG. 1A shows an isometric top-left view of a motorized sliding segment in a frame.
Figure 1B:
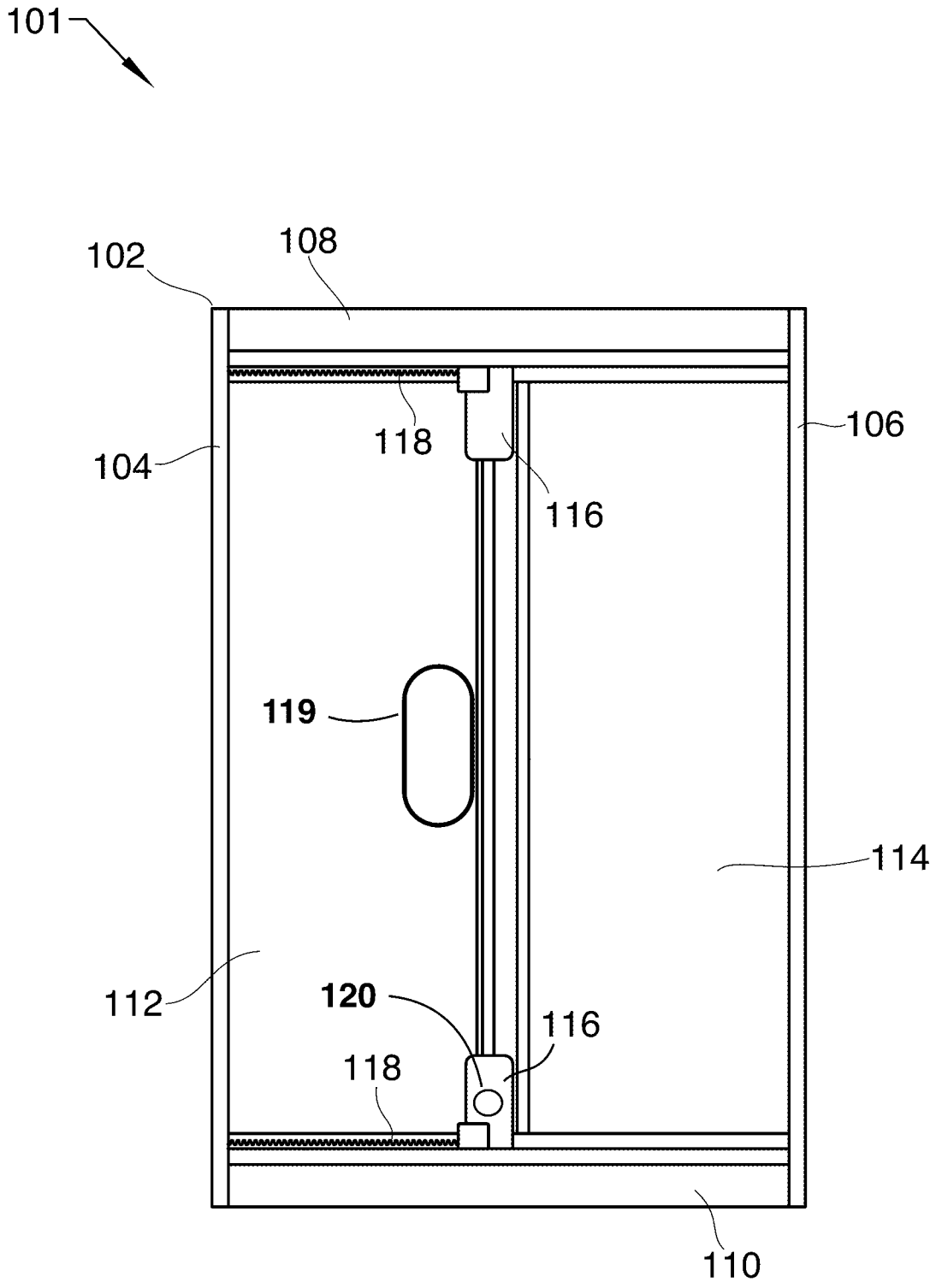
FIG. 1B shows a front isometric view of the frame of FIG. 1A.

Referring now to the Figures, FIG. 1A shows an isometric top-left view 100 of a motorized sliding segment 116 mounted slidably in a frame 102 that may be used in the described devices, systems, and methods. FIG. 1B shows a front isometric view of the frame of FIG. 1A. The frame 102 may be a window frame or a door frame. The frame includes a fixed segment 112, top horizontal member 108, bottom horizontal member 110, left vertical member 104, and right vertical member 106. The track for the sliding segment 114 is offset from the fixed segment 112 so that the sliding segment can open and close. It is appreciated that before the addition of any motor assemblies 116, the sliding segment 114 is manually operated (the sliding segment 114 and frame 102 may be "dumb" or non-smart devices).

Motor assemblies 116 are affixed to the top and/or bottom of the left side of the sliding segment 114. Although two motor assemblies 116 are shown in FIG. 1, any number of motor assemblies 116 may be used, including just one as illustrated in FIG. 3. While the left side is identified, it is appreciated that a motor assembly 116 may be affixed to any location on the sliding segment 114 without departing from the scope of the present systems, devices, and methods. Motor assemblies 116 contain a motor and a gear, as described in FIG. 2. Gear tracks 118 are affixed to the top and bottom horizontal members 108 and 110. The gears mesh with the teeth of the gear tracks 118. The motors turn the gears in a first direction, causing the gears to walk along the gear tracks 118, causing the slidable segment 114 to slide towards this vertical member. Rotation the opposite direction walks the gears the other direction, pulling the slidable segment the other direction. In the present instance, the motor assemblies 116 are mirror images of one another, and so the motors turn opposite each other to walk the same direction. In other words, the motors are antiparallel to each other. In the present embodiment gear tracks 118 are designed to retrofit already installed windows, in this embodiment the tracks are designed to be applied directly to the horizontal members of the frame. There are a variety of methods for applying the gear tracks that include but are not limited to; adhesive applied to the side of the track without gear teeth, (a peel and stick option), fastening devices such as nails or screws, or slide on track that rests on the horizontal member with the teeth on one side and the other side being smooth. In another embodiment the gear track is molded into the horizontal member. In the current embodiment gear track 118 is depicted as being within the channel the slideable segment runs in, it should be noted that in another embodiment gear track 118 may be on the side of the horizontal member, thus facing into the room. In one embodiment the motors are powered by batteries, in certain embodiments they are rechargeable batteries, and are powered by solar cells 119. The solar cells 119 are oriented so that the photovoltaic portion is facing outside. In one embodiment the motor assembly includes a temperature sensor 120, for monitoring the temperature of the room.

In some embodiments, the motor assembly 116 include a transmission (not shown). The transmission may include one or more gears that convert rotational speed to rotational torque for driving the gear that meshes with the teeth of the gear track. In some cases, the transmission is configured such that the transmission can only be driven by the motor of the motor assembly 116 (cannot be driven by the gear, for example). For instance, the transmission may include a worm gear that may be driven by the motor to drive the gear, but that locks the gear in place when the motor is not spinning (the gear cannot be used to turn the worm gear, for example). Thus, the transmission locks the slidable segment 114 in place in whatever position the slidable segment 114 is in. In contrast to typical locking mechanisms that only lock a slidable segment when the slidable segment is in a closed position, the transmission locks the gear in place in the teeth of the gear track in whatever place in the gear track that the gear is at. The slidable segment 114 may be locked in place when the slidable segment 114 is closed as with typical locking mechanisms but could also lock the slidable segment 114 in place when the slidable segment 114 is any degree of partly open or even fully opened. This feature may allow for the slidable segment 114 to be partly opened, while still providing security that the slidable segment 114 cannot be opened further or closed outside of an authorized user's control (when the motor is driven, for example). The transmission lock adds an element of home security to the window, a typical window frame will not lock in a partially open position, the transmission lock allows the window to be partially open, without the possibility of opening further. The ability to open a window, thus allowing air to flow in or out, while eliminating the possibility of opening the window further is feature many people are looking for. It can allow fresh air in without endangering the occupants or opening their possessions to theft. The transmission lock is at least as strong as the latch lock that is a part of sliding windows, in this way the transmission lock adds better safety with more options.

While some embodiments do not have coordinated motors 116 there are advantages to coordinated motors 116. In those embodiments with two motors 116 the top and the bottom of the window or door open together, in this way there is no tilting or canting of the slideable segment. With one motor 116 the top and bottom may not slide at the same rate, this can lead to tilting or canting of the slideable segment, if the slideable segment tilts or cants, the segment may bind, or get stuck, this can lead to damage to the motor assembly or the gear track, or even damage to the window. This effect becomes more pronounced the larger the window or door. While larger windows or doors have a greater tendency to tilt and bind, the effect is not exclusive to a large window or door, therefore coordinated motors on the top and bottom are preferred.

It will be noted that while the drawings depict a window that opens and closes in a horizontal orientation, the motor is capable of functioning with a window that slides in a vertical orientation. In the vertical orientation the motor or motors will be affixed to the side vertical members instead of the upper and lower horizontal members. The gear track will also be attached to the side vertical members. In the vertical orientation coordinating the motors becomes especially important so the sliding segment will raise and lower. When the motor or motors are not coordinated there is a greater chance of the sliding segment tilting or canting and binding up so the sliding segment will stick and no longer move. The motor connected to a vertically oriented sliding window will retain all the characteristics of the motor connected to a horizontally sliding window.

Figure 2:
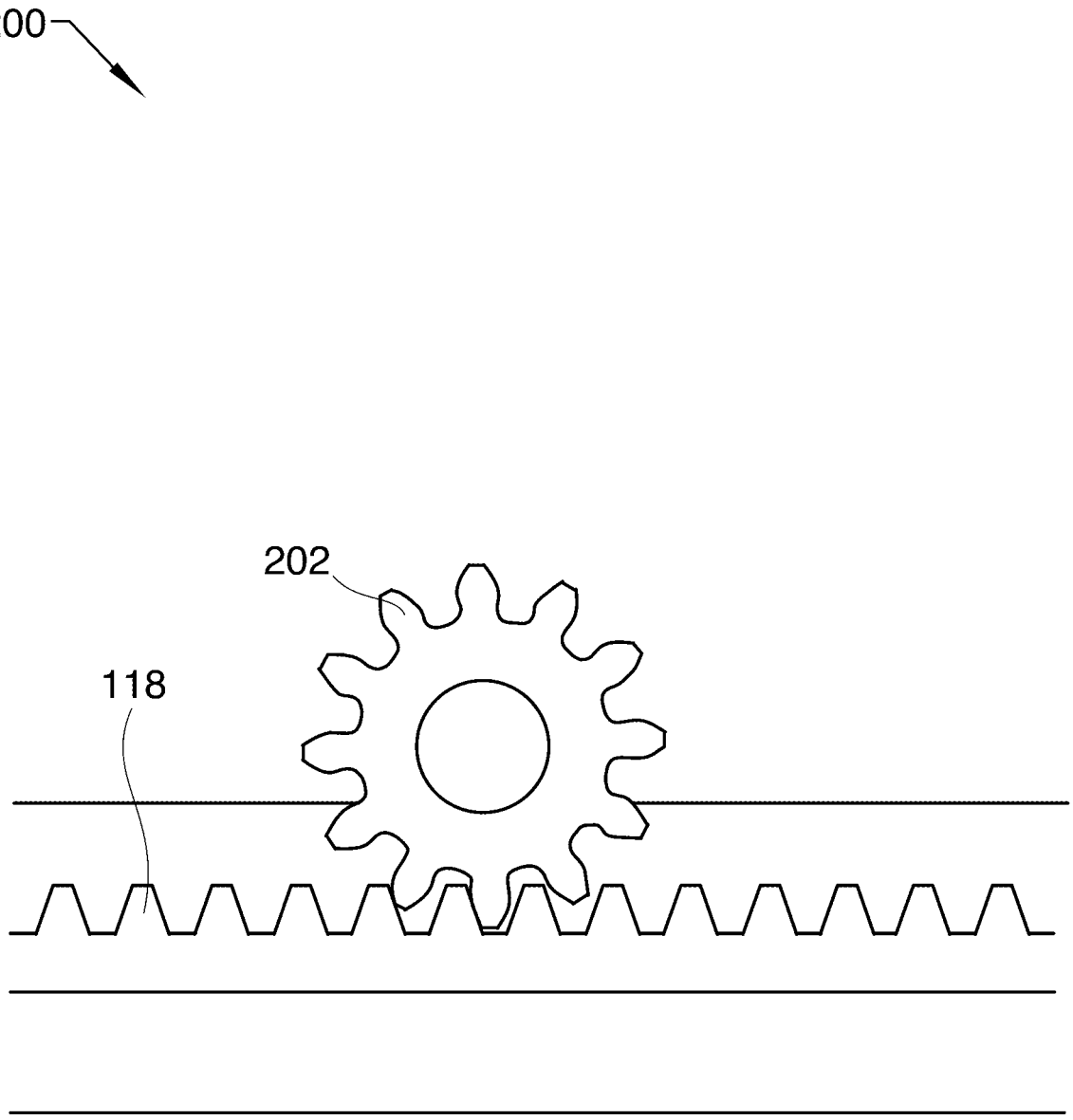
FIG. 2 shows an isometric view of one of the motor/pulley assemblies of FIG. 1A.

Referring to FIG. 2, FIG. 2 shows a cutaway cross-sectional isometric view 200 of one of the gear tracks 118 of FIG. 1A with its associated gear 202. The gear 202 turns, the teeth engaging the gear track 118. As the gear track 118 is affixed to one of the horizontal members, this forces the slidable segment 114 to slide open or closed.

Figure 3A:
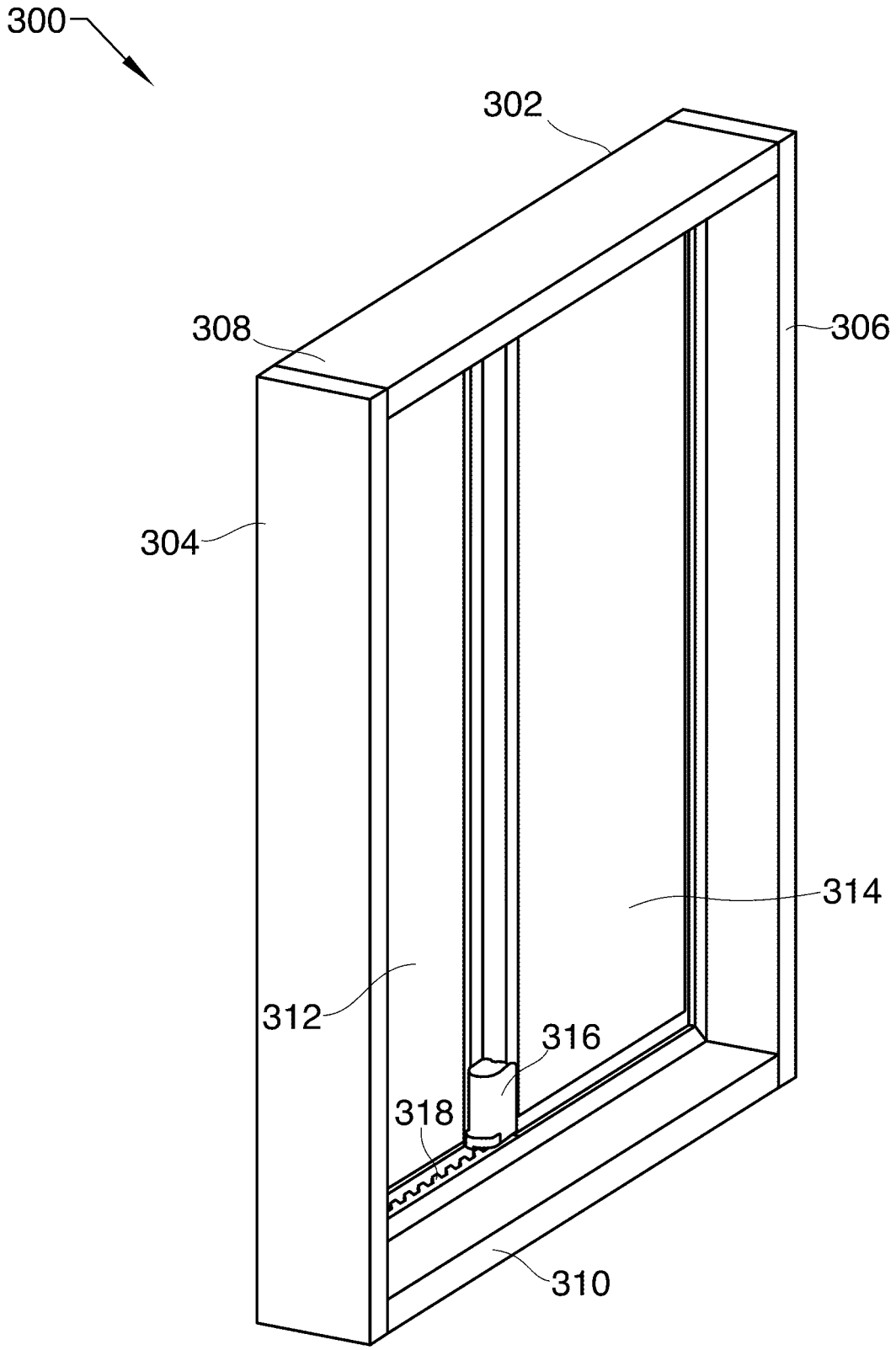
FIG. 3A shows an isometric top-left view of a motorized sliding segment in a frame.
Figure 3B:
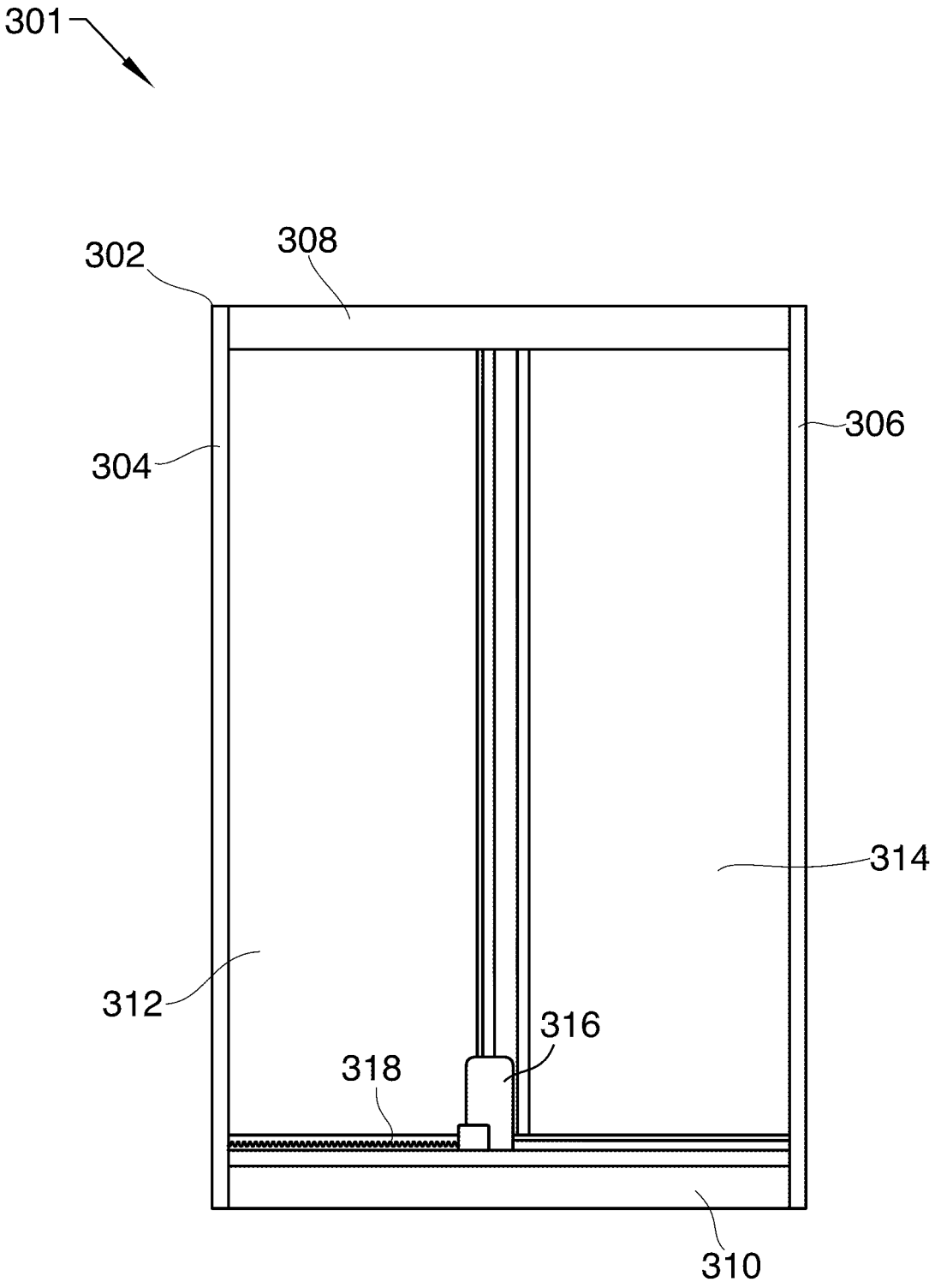
FIG. 3B shows a front isometric view of the frame of FIG. 3A.

Referring now to the Figures, FIG. 3A shows an isometric top-left view 300 of a motorized sliding segment 314 mounted slidably in a frame 302 that may be used in the described devices, systems, and methods. FIG. 3B shows a front isometric view of the frame of FIG. 3A. The frame 302 may be a window frame or a door frame. The frame includes a fixed segment 312, top horizontal member 308, bottom horizontal member 310, left vertical member 304, and right vertical member 306. The track for the sliding segment 314 is offset from the fixed segment 312 so that the sliding segment can open and close.

Motor assembly 316 is affixed to the bottom of the left side of the sliding segment 314. Motor assembly 316 contains a motor and a gear, as described in FIG. 2. A gear track 318 is affixed to the bottom horizontal member 310. The gear meshes with the teeth of the gear track 318. The motor turns the gear in a first direction, causing the gear to walk along the gear track 318, causing the slidable segment 314 to slide towards this vertical member. Rotation the opposite direction walks the gear the other direction, pulling the slidable segment the other direction.

In some embodiments, the motor assembly 316 includes a transmission (not shown). The transmission may include one or more gears that convert rotational speed to rotational torque for driving the gear that meshes with the teeth of the gear track. In some cases, the transmission is configured such that the transmission can only be driven by the motor of the motor assembly 316 (cannot be driven by the gear, for example). For instance, the transmission may include a worm gear that may be driven by the motor to drive the gear, but that locks the gear in place when the motor is not spinning (the gear cannot be used to turn the worm gear, for example). Thus, the transmission locks the slidable segment 314 in place in whatever position the slidable segment 314 is in. So in contrast to typical locking mechanisms that only lock a slidable segment when the slidable segment is in a closed position, the transmission locks the gear in place in the teeth of the gear track in whatever place in the gear track that the gear is at. So the slidable segment 314 may be locked in place when the slidable segment 314 is closed as with typical locking mechanisms but could also lock the slidable segment 314 in place when the slidable segment 314 is any degree of partly open or even fully opened. This feature may allow for the slidable segment 314 to be partly opened, while still providing security that the slidable segment 314 cannot be opened further or closed outside of an authorized user's control (when the motor is driven, for example). The transmission lock adds an element of home security to the window, a typical window frame will not lock in a partially open position, the transmission lock allows the window to be partially open, without the possibility of opening further. The ability to open a window, thus allowing air to flow in or out, while eliminating the possibility of opening the window further is feature many people are looking for. It can allow fresh air in without endangering the occupants or opening their possessions to theft.

Figure 4:
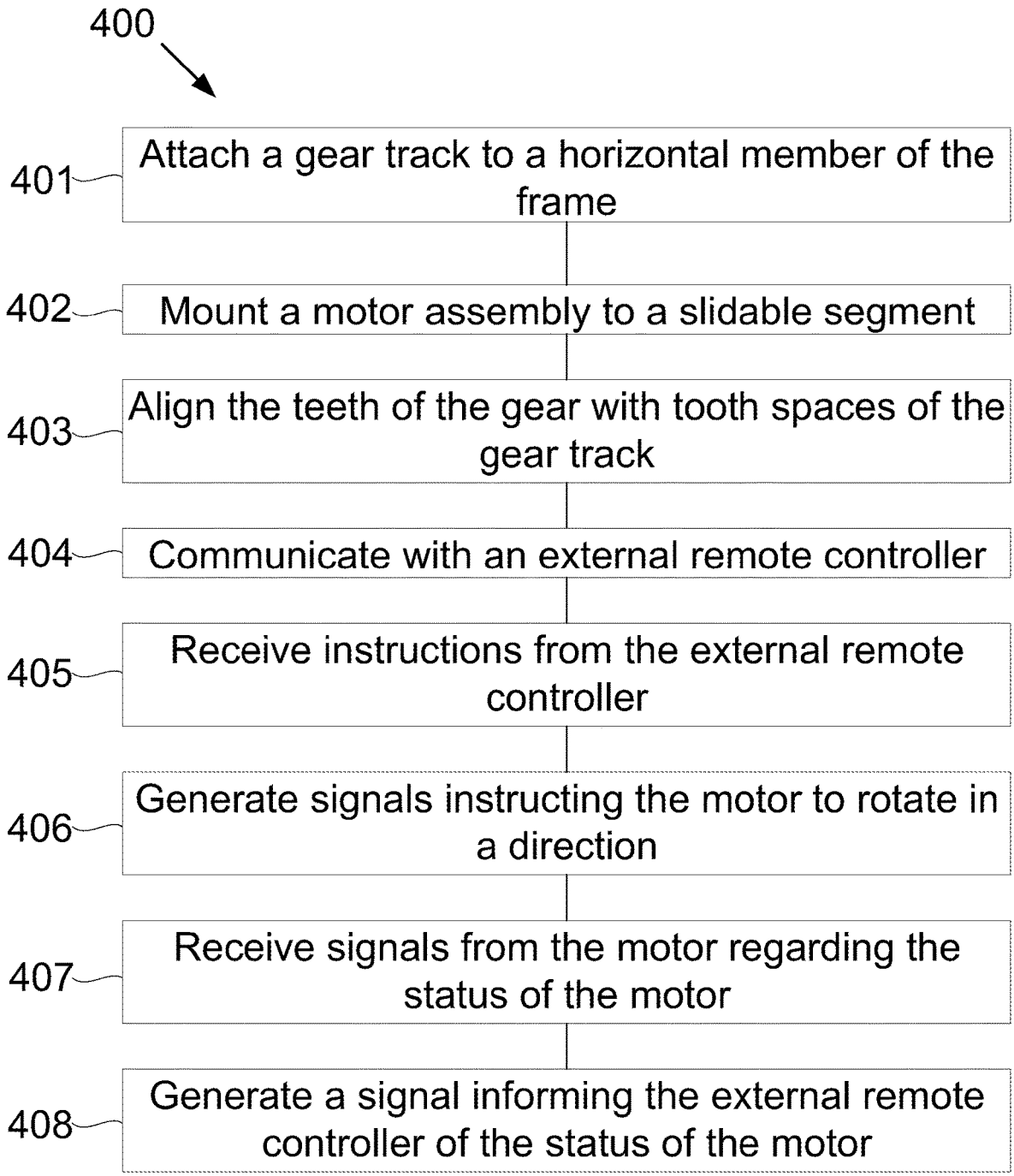
FIG. 4 shows a method for automating a slidable segment of a frame.

Referring to FIG. 4, FIG. 4 shows a method 400 for automating a slidable segment of a frame using the described devices, systems, and methods. At 401, a gear track is attached to a horizontal member of the frame. At 402, a motor assembly is mounted to a slidable segment, the slideable segment being slidably mounted within the frame. The motor assembly comprises a motor turning a gear. At 403, the teeth of the gear are aligned with tooth spaces of the gear track. The motor has one or more communication systems. At 404, the one or more communication systems communicate with an external remote controller. At 405, the one or more communication systems receive instructions from the external remote controller. At 406, the one or more communication systems generate signals instructing the motor to rotate in a direction. At 407, the one or more communication systems receive signals from the motor regarding a status of the motor. At 408, the one or more communication systems generate a signal informing the external remote controller of the status of the motor.

Although the operations of method 400 are illustrated as being performed in a particular order, it is understood that the operations of method 400 may be reordered without departing from the scope of the method.

In some embodiments, the motor includes one or more communication systems. These may include Bluetooth communication chips, Internet Wi-Fi transceivers, network transceivers, a Z-Wave network transceiver, or a combination thereof. In some embodiments, the one or more communication systems communicate with an external remote controller. In some embodiments, the one or more communication systems receive instructions from the external remote controller, generate signals instructing the motor to rotate in a direction, receive signals from the motor regarding a status of the first motor, and generate a signal informing the external remote controller of the status of the motor. In some embodiments the external remote controller communicates with or is connected to a home automation service, such as those devices and systems offered by Nest Labs (it will be obvious that there are many options for home automation, any of which will perform similar functions to those from Nest Labs) is used only as an example). In some embodiments the one or more communications systems communicate with the home automation device. The home automation device is capable of measuring many conditions that are present in a home. These include internal and external temperatures, carbon monoxide levels, carbon dioxide levels, the presence of smoke, and many other conditions. In some embodiments the sliding window motor and the home automation device are configured to open the window when carbon monoxide is detected. In some embodiments the sliding window motor and the home automation device are configured such that the home automation device can determine whether opening or closing the window will cool the home.

In some embodiments, the motor includes one or more communication systems. These may include Bluetooth communication chips, Internet Wi-Fi transceivers, network transceivers, a Z-Wave network transceiver, or a combination thereof. In some embodiments, the one or more communication systems communicate with a smart device such as a smartphone or tablet. In some embodiments, the one or more communication systems receive instructions from the smart device, generate signals instructing the motor to rotate in a direction, receive signals from the motor regarding a status of the first motor, and generate a signal informing the smart device of the status of the motor.

In some embodiments the sliding window motor includes a portable fan that fits between the slidable portion 114 of the window and the window screen. The fan can be turned on to increase the amount of cool air pulled into the room when the sliding window motor opens the window. In some embodiments the portable fan is configured to automatically turn on when the sliding window motor opens the window.

In some embodiments, the motor has and is powered by one or more batteries. In other embodiments, the motor has and is powered by power lines. In some embodiments the motor is powered by solar power. The motor may be connected to In some embodiments, the slidable segment is slidably mounted by being between tracks on a top horizontal member of the frame and a bottom horizontal member of the frame, the tracks allowing the slidable frame to freely move side to side.

In some embodiments, the frame has a latching device that mates to a latching receiver attached to the slidable segment, wherein mating prevents movement of the slidable segment. In some embodiments, the latching receiver comprises a communication device that generates a signal when the latching device is mated and transmits that signal to the motor, wherein the signal deactivates the motor.

In some embodiments, the first gear track is attached to the horizontal member of the frame by adhesive, screws, nails, or a combination thereof. In some embodiments, the first motor assembly is mounted to the slidable segment by adhesive, screws, nails, or a combination thereof.

In some embodiments, the first gear track is attached in the track that the slidable segment slides in. In other embodiments, the first gear track is attached adjacent to the track that the slidable segment slides on.

The invention claimed is:

1. A device comprising:

a frame and a slidable segment that is slidably mounted within the frame and configured to slide horizontally within the frame, wherein the frame comprises a horizontal first open channel with two parallel walls that retain the slidable segment as it slides in the frame horizontally, wherein the slidable segment has an external vertical side surface that is perpendicular to the parallel walls;

a first motor retrofittably mounted to the external vertical side surface of the slidable segment at a bottom of the external vertical side surface, a first gear affixed to and driven by the first motor, a first gear track retrofittably mounted to a surface of one of the two parallel walls of the first open channel, wherein teeth of the first gear align with tooth spaces of the first gear track, wherein rotating the first gear in a first rotational direction causes the first gear to pull the slidable segment in a first linear direction as the first gear walks along the first gear track, and wherein rotating the first gear in a second rotational direction causes the first gear to pull the slidable segment in a second linear direction as the first gear walks along the first gear track.

2. The device of claim 1, wherein the frame comprises a second open channel, parallel to and opening toward the first open channel, which second open channel comprises two parallel walls, the device further comprising a second motor retrofittably mounted to the slidable segment, a second gear affixed to and driven by the second motor, a second gear track retrofittably mounted to one of the two walls of the second open channel, and wherein teeth of the second gear align with tooth spaces of the second gear track.

3. The device of claim 2, wherein:

the first gear and the second gear are oriented anti-parallel to each other, wherein rotating the second gear in the second rotational direction causes the second gear to pull the slidable segment, in conjunction with the first gear, in the first linear direction as the second gear walks along the second gear track, and rotating the second gear in the first rotational direction causes the second gear to pull the slidable segment, in conjunction with the first gear, in the second linear direction as the second gear walks along the second gear track.

4. The device of claim 2, wherein the first and second open channel are horizontal, so that the slidable segment travels in a horizontal direction.

5. The device of claim 1, wherein the device further comprises a fixed segment offset from the slidable segment such that the slidable segment can slide past the fixed segment.

6. The device of claim 1, wherein the first motor comprises one or more communication systems comprising Bluetooth communication chips, Internet Wi-Fi transceivers, network transceivers, a Z-Wave network transceiver, or a combination thereof, and wherein the one or more communication systems communicate with an external remote controller.

7. The device of claim 6, wherein the one or more communication systems receive instructions from the external remote controller, generate signals instructing the first motor to rotate in a direction, receive signals from the first motor regarding a status of the first motor, and generate a signal informing the external remote controller of the status of the first motor.

8. The device of claim 1, wherein the first motor includes a transmission that drives the first gear, wherein the transmission prevents the first gear from rotating when the transmission is not driven by the motor such that the transmission locks the slidable segment in place when the transmission is not driven by the motor.

9. The device of claim 1, wherein the device further comprises one or more batteries and the motor is powered by the one or more batteries.

10. The device of claim 1, wherein the device further comprises a power line and the motor is powered by the power line.

11. The device of claim 1, wherein the frame comprises a latching device that mates to a latching receiver attached to the slidable segment, wherein mating prevents movement of the slidable segment.

12. The device of claim 11, wherein the latching receiver comprises a communication device that generates a signal when the latching device is mated and transmits that signal to the motor, wherein the signal deactivates the motor.

13. A device comprising:

a frame and a slidable segment that is slidably mounted within the frame and configured to slide horizontally within the frame, wherein the frame comprises a horizontal first open channel with two parallel walls that retain the slidable segment as it slides in the frame horizontally, wherein the slidable segment has a vertical side surface that is perpendicular to the parallel walls;

a first motor retrofittably mounted to the vertical side surface of the slidable segment at a bottom of the vertical side surface, a first gear affixed to and driven by the first motor, a first gear track retrofittably mounted to a surface of one of the two parallel walls of the first open channel, wherein teeth of the first gear align with tooth spaces of the first gear track, wherein rotating the first gear in a first rotational direction causes the first gear to pull the slidable segment in a first linear direction as the first gear walks along the first gear track, and wherein rotating the first gear in a second rotational direction causes the first gear to pull the slidable segment in a second linear direction as the first gear walks along the first gear track, wherein the motor is as wide as the horizontal first open channel.

14. A method for automating a slidable segment in a frame comprising:

retrofittably attaching a first gear track to a surface of one of two parallel walls of an open channel member of the frame, wherein the slidable segment is slidably retained in the open channel member, wherein the slidable segment has an exterior vertical side surface perpendicular to the parallel walls;

aligning teeth of a first gear with tooth spaces of the first gear track;

retrofittably mounting a first motor assembly to the exterior vertical side surface of the slidable segment, wherein the first motor assembly comprises a first motor turning the first gear.

15. The method of claim 14, wherein the first motor comprises one or more communication systems comprising Bluetooth communication chips, Internet Wi-Fi transceivers, network transceivers, a Z-Wave network transceiver, or a combination thereof.

16. The method of claim 15, wherein the one or more communication systems communicate with an external remote controller, and wherein the one or more communication systems receive instructions from the external remote controller, generate signals instructing the first motor to rotate in a direction, receive signals from the first motor regarding a status of the first motor, and generate a signal informing the external remote controller of the status of the first motor.

17. The method of claim 14, wherein the motor assembly includes a transmission that drives the first gear, wherein the transmission locks the slidable segment to the first gear track when the transmission is not driven by the motor.

* * * * *